US007055938B1

(12) United States Patent
Ohkuma et al.

(10) Patent No.: US 7,055,938 B1
(45) Date of Patent: Jun. 6, 2006

(54) LIQUID JET RECORDING HEAD AND PROCESS FOR PRODUCTION THEREOF

(75) Inventors: Norio Ohkuma, Yokohama (JP); Masashi Miyagawa, Yokohama (JP); Hiroaki Toshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 37 days.

(21) Appl. No.: 08/634,255

(22) Filed: Apr. 18, 1996

(30) Foreign Application Priority Data

Apr. 21, 1995 (JP) ..... 7-096737

(51) Int. Cl.
*B41J 2/05* (2006.01)

(52) U.S. Cl. ..... 347/65; 347/20

(58) Field of Classification Search ..... 347/65, 347/47, 63, 64, 20, 56, 61, 67; 525/507, 525/508, 533, 523; 528/110
See application file for complete search history.

(56) References Cited

U.S. PATENT DOCUMENTS

| | | | | |
|---|---|---|---|---|
| 3,720,639 A | | 3/1973 | Griffith | 260/33.4 EP |
| 3,852,222 A | * | 12/1974 | Field et al. | 260/2 EP |
| 4,816,545 A | | 3/1989 | Re et al. | 528/401 |
| 5,119,116 A | * | 6/1992 | Yu | 347/65 |
| 5,166,265 A | * | 11/1992 | Nakahata et al. | 525/101 |
| 5,331,344 A | | 7/1994 | Miyagawa et al. | 347/63 |
| 5,458,254 A | * | 10/1995 | Miyagawa et al. | 216/27 |
| 5,478,606 A | * | 12/1995 | Ohkuma et al. | 427/555 |

FOREIGN PATENT DOCUMENTS

| | | | | |
|---|---|---|---|---|
| EP | 0230112 A2 | | 7/1987 | |
| EP | 0388979 A2 | | 9/1990 | |
| EP | 0609860 A2 | | 8/1994 | |
| JP | 57-157765 | | 9/1982 | |
| JP | 57-208255 | | 12/1982 | |
| JP | 57-208256 | | 12/1982 | |
| JP | 60-115622 | | 6/1985 | |
| JP | 60-161973 | | 8/1985 | |
| JP | 61-154947 | | 7/1986 | |
| JP | 63-221121 | | 9/1988 | |
| JP | 64-9216 | | 1/1989 | |
| JP | 2-140219 | | 5/1990 | |
| JP | 3-184868 | | 8/1991 | |
| JP | 5138882 | * | 6/1993 | 347/65 |

OTHER PUBLICATIONS

Journal of Polymer Science: Polymer Chemistry Edition, vol. 21, No. 1, pp. 97-109, Jan. 1983.
Journal of Polymer Science: Polymer Symposia, Fourth International Symposium on Cationic Polymerization, No. 56, pp. 383-395, 1976.

* cited by examiner

*Primary Examiner*—Juanita D. Stephens
(74) *Attorney, Agent, or Firm*—Fitzpatrick, Cella, Harper & Scinto

(57) ABSTRACT

A liquid jet recording head comprises a constituting member formed from a cured product of a resin composition comprising (1) a curable epoxy compound, (2) a compound having a functional group reactive to the curable epoxy compound and a fluorocarbon moiety, and (3) a curing agent.

14 Claims, 3 Drawing Sheets

LIQUID JET RECORDING HEAD AND PROCESS FOR PRODUCTION THEREOF

BACKGROUND OF THE INVENTION

1. Field of the Invention

The present invention relates to a liquid jet recording head for discharging droplets of recording liquid in an ink jet recording system.

2. Related Background Art

A liquid jet recording head used in an ink jet recording apparatus (liquid jet recording system) has generally a fine recording liquid discharge opening (hereinafter often referred to as an "orifice"), a liquid flow path, and an energy-generating device provided in the liquid flow path for generating energy for discharging the liquid. Such a liquid jet recording head is conventionally produced by forming a fine groove on a glass or metal plate by cutting, etching, or a like working method, and then bonding the grooved plate to another suitable plate to form a liquid flow path.

However, the working precision is limited in cutting or etching of the glass plate or the metal plate. Moreover, the liquid jet recording heads produced by such a conventional method do not necessarily have invariable flow resistances of liquid flow paths because of roughness of the inner flow path walls or distortion of the flow paths caused by nonuniform etching, whereby the recording characteristics of the produced liquid jet recording heads tend to vary disadvantageously.

Further, the cutting is liable to cause chipping or cracking of the plate to result in a lower production yield. On the other hand, the etching, which is conducted through many production steps, results in high production cost. Furthermore, a common disadvantage of the aforementioned conventional methods is difficulty in positional registration in bonding the grooved plate having the liquid flow paths to a cover plate having a discharge-energy-generating element such as a piezo element or electrothermal transducer element. Therefore, conventional methods are not suitable for mass production.

Production processes offsetting the above disadvantages are disclosed in Japanese Patent Application Laid-Open Nos. 57-208255, 57-208256, and 61-154947.

In the methods disclosed in the above Japanese Patent Application Laid-Open Nos. 57-208255 and 57-208256, a pattern of nozzles including ink flow paths and orifices is formed from a photosensitive resin material on a base plate on which discharge energy-generating elements have been formed, and thereon a cover plate like a glass plate is bonded. However, such a method involves the problems below:

(1) The adhesive for bonding the cover plate may penetrate into the ink flow path to deform the flow path.
(2) In cutting the base plate to form the ink discharge opening, cut chips may be brought into the ink flow path to render the ink ejection instable.
(3) A portion of the ink discharge opening may be chipped in cutting the base plate having a hollow for the ink flow path.

These problems lower the yield of production of the liquid jet recording heads, and render difficult the production of a multiple recording head which has a fine ink flow path structure having many ink discharge openings on a broad nozzle face.

Japanese Patent Application Laid-Open Nos. 61-154947 discloses a method for solving the above problems. In this method, an ink flow path pattern is formed from a soluble resin, the formed pattern is coated with an epoxy resin or the like, the epoxy resin is cured, the substrate is cut, and the soluble resin is removed by elution.

With progress of technique in recent years, the recording is required to be finer and more precise. To satisfy the requirement, one method is to decrease the cross-sectional area of the orifice, which requires working technique for a finer orifice. In the methods disclosed in the aforementioned Japanese Patent Application Laid-Open Nos. 57-208255, 57-208256, and 61-154947, the ink discharge opening is formed by cutting the ink flow path, thus the distance between the ink discharge pressure generating-element and the ink discharge opening depends on the cutting precision. However, since the cutting is conducted generally by a mechanical means such as a dicing saw, the high precision is not readily achievable, and the substrate may be chipped to cause ink discharge in a wrong direction to impair the quality of printing.

To solve the above problems, a method for producing a liquid jet recording head was disclosed by the inventors of the present invention, which comprises the steps of:

(1) forming an ink flow path pattern from a soluble resin on an ink discharge pressure-generating element having been provided on a base plate,
(2) forming a coating resin layer on the layer of the above soluble resin,
(3) forming an ink discharge opening in the coating resin layer, and
(4) removing the soluble resin layer by elution.

In the above process of producing the liquid jet recording head, the distance between the discharge energy-generating element and the orifice, the most important factor for the characteristics of the liquid jet recording head, can be controlled precisely with high reproducibility by a thin film coating technique exemplified by spin coating. The positional registration of the discharge energy-generating element to the orifice can be conducted optically by photolithography with high positional precision.

The methods disclosed in the aforementioned Japanese Patent Application Laid-Open Nos. 57-208255, 57-208256, and 61-154947, which employ oxygen plasma, use a resin composition having higher workability than glass or metals as the material for the liquid jet recording head. Japanese Patent Application Laid-Open No. 3-184868 discloses a cation-polymerized and cured product of an aromatic epoxy compound as a coating resin suitable for the method described in the above Japanese Patent Application Laid-Open No. 61-154947.

The liquid jet recording head is kept incessantly in contact with ink (generally mainly composed of water, and not neutral) in the environment of use. Therefore, the constituting members are required to be affected little by the recording liquid. Change of the dimension, deterioration of adhesion to the base plate, and decrease of mechanical strength of the constituting member should be prevented which are caused by water absorption of the constituting member from the ink during a long term of use.

Generally, a cation-polymerized cured epoxy resin has high crosslinking density and a high glass transition temperature to have excellent mechanical strength and adhesiveness. However, with the resin, the water absorption is not proportional to the crosslinking density, and the water absorbency reaches the minimum in a certain crosslinking range. Therefore the desirable properties of high strength and high adhesiveness are not necessarily consistent with the minimum water absorbency.

After comprehensive study on the above problems, it has been found by the present inventors that the water absorbency of the cured epoxy resin is lowered by curing the epoxy resin in the presence of, or by reaction with a compound having a fluorocarbon moiety by utilizing the low surface tension of the fluorocarbon moiety-containing compound.

SUMMARY OF THE INVENTION

An object of the present invention is to provide a liquid jet recording head composed of a material having low water absorbency, high adhesiveness to a base plate, and high mechanical strength.

Another object of the present invention is to provide a process for producing the above liquid jet recording head.

The liquid jet recording head of the present invention comprises a constituting member formed from a cured product of a resin composition comprising:

(1) a curable epoxy compound,
(2) a compound having a functional group reactive to the curable epoxy compound and a fluorocarbon moiety, and
(3) a curing agent.

The process for producing the liquid jet recording head of the present invention comprises steps of:

(I) forming an ink flow path pattern from a soluble resin on a base plate provided with an ink discharge pressure-generating element,
(II) forming a coating resin layer on the pattern of the soluble resin, and
(III) removing the soluble resin layer by elution, wherein the coating resin layer is formed from a cured product of a resin composition comprising:
(1) a curable epoxy compound,
(2) a compound having a functional group reactive to the curable epoxy compound and a fluorocarbon moiety, and
(3) a curing agent.

DETAILED DESCRIPTION OF THE PREFERRED EMBODIMENTS

Figure 1:
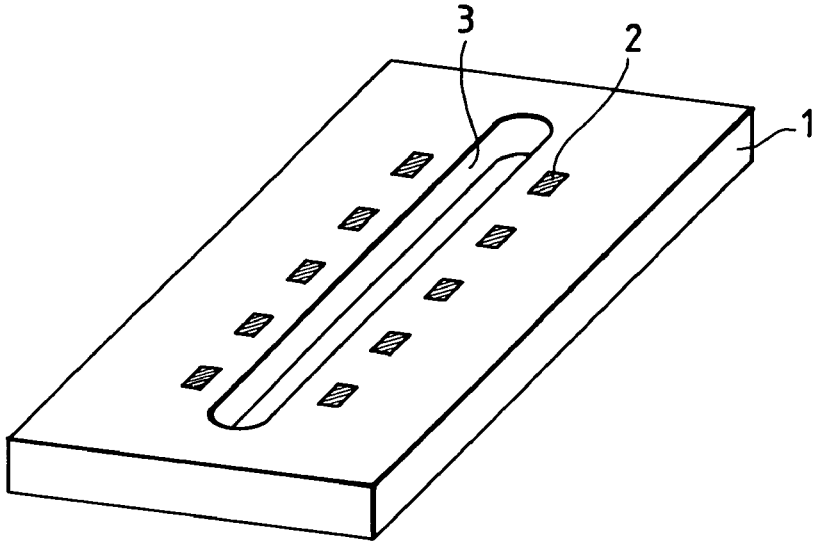
FIG. 1 is a schematic perspective view showing a base plate before the formation of an ink flow path.

An embodiment of constitution and effects of a liquid jet recording head of the present invention is described below.

This embodiment is characterized by the constituting member for the main portion of the recording head. The resin composition for forming the recording head of the present invention is described below in detail.

As a component of the resin composition, the curable epoxy resin has preferably two or more epoxy groups in the molecule in order to obtain high mechanical strength and high adhesiveness to the base plate of the cured product. Specific examples include epoxy resins having skeleton of bisphenols A, F, and S, and epoxy resins of o-cresol novolak type, which are described in the aforementioned Japanese Patent Application Laid-Open No. 3-184868. Further, alicyclic epoxy resins are also useful which have not been used so far because of their high water absorbency of the cured products than that of the cured aromatic epoxy resins in spite of their high cationic polymerizability. However, the alicyclic epoxy resins should be used carefully in certain embodiments in consideration of high compatibility with naphthoquinone diazide type positive type resist.

Epoxy resins having an oxycyclohexane skeleton are also useful which are described in Japanese Patent Application Laid-Open Nos. 60-161973, 63-221121, 649216, and 2-140219. In particular, the above cured epoxy resins having an oxycyclohexane skeleton have excellent adhesiveness to the base plate, and is capable of compensating the decrease of the adhesiveness caused by addition of a fluorocarbon moiety-containing compound.

The compound having a functional group reactive to the curable epoxy compound and a fluorocarbon moiety (hereinafter often referred to as a "fluorocarbon moiety-containing compound") is explained below. This compound is incorporated into the three-dimensional network structure in curing of the epoxy resin by reaction with the epoxy ring, and the fluorocarbon moiety serves to lower the water absorbency. At least a portion of the compound having a functional group reactive to the curable epoxy compound and a fluorocarbon moiety should be compatible with, and bonded chemically to the epoxy resin. If the compound having a fluorocarbon moiety is completely separated from the epoxy resin (incompatible or dispersed), the water absorbency is not always decreased sufficiently, the properties of the cured epoxy resin (mechanical strength, etc.) may be adversely affected, or the fluorocarbon moiety-containing compound may be eluted into the ink during a long term of use.

The fluorocarbon moiety-containing compound is contained preferably in the range of from 1% to 50% by weight, more preferably from 5% to 30% by weight of the cured epoxy resin. At the content of less than 1% by weight, the fluorocarbon moiety-containing compound does not lower sufficiently the water absorbency, whereas at the content of higher than 50% by weight, it may impair the characteristic property, namely the mechanical strength and the adhesiveness to the base plate, of the epoxy resin. The content is particularly preferably not more than 30% by weight in consideration of compatibility with the aforementioned epoxy resin.

The fluorocarbon moiety-containing compound contains fluorine at a content ranging from 20% to 80% by weight. At the content of lower than 20% by weight, the effect is insufficient, whereas at the content of higher than 80%, the compound will lose its compatibility with usual epoxy compounds and organic solvents.

The functional group of the fluorocarbon moiety-containing compound includes groups of epoxy, hydroxyl, carboxyl, and amino. When the curing is conducted through cationic polymerization by use of a cationic polymerization initiator as the curing agent, the hydroxyl group is particularly preferred since the hydroxyl group furnishes hydrogen for the cationic polymerization and the fluorocarbon moiety-containing compound serves as a chain transfer agent. The functional group is selected depending on the kind of the curing reaction of the epoxy resin. Naturally, a nucleophilic functional group like an amine group cannot be applicable to a cationic curing polymerization reaction.

Specific examples of the above fluorocarbon moiety-containing compound shown by chemical formulas below without limiting the invention thereto.

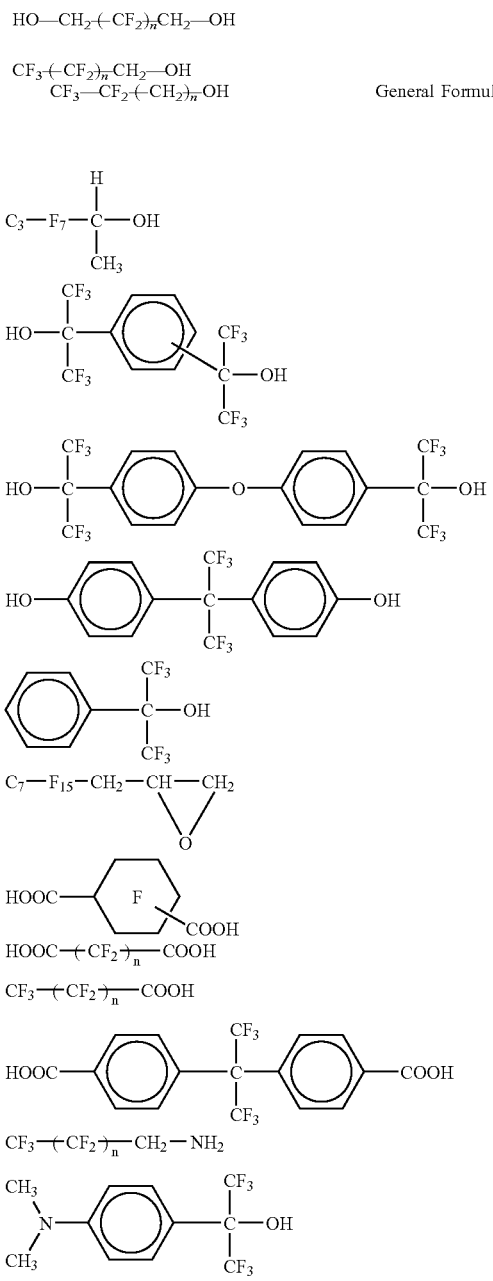

General Formula (1)

(n is an integer of 1–20)

Of these compounds, in cationic curing polymerization, the fluorocarbon moiety-containing compound having a hydroxyl group, particularly the diols represented by the above General Formula (1) is preferred, since the diols serve as a chain transfer agent of cationic polymerization as mentioned above.

The epoxy compound is cured by crosslinking with a suitable curing agent. The curing agent includes known amine type curing agents, acid anhydride type curing agents, and cation-polymerization curing agents. The amine type curing agents include aliphatic amines such as diethylenetriamine, 2,5 dimethyl-hexamethylenediamine, and diethylenetriamine; cyclic amines such as menthenediamine, and isophoronediamine; and aromatic amines such as m-xylenediamine, and m-phenylenediamine. The acid anhydride type curing agents include polyadipic anhydride, hexahydrophthalic anhydride, and promellitic anhydride. The cationic polymerization type of curing agent is suitably used in the examples of the present invention. The cation-polymerized cured epoxy resin has advantages of a high crosslinking density and a high glass-transition temperature (heat distortion temperature).

In curing reaction of the epoxy compound, an amine type curing agent or an acid anhydride type curing agent requires a high temperature and a long reaction time for curing. The higher reaction degree of the reactive epoxy group gives the higher transition temperature, the higher mechanical strength, and the higher adhesiveness. Therefore, use of the amine type curing agents or the acid anhydride type curing agents are limited in throughput. In contrast thereto, cationic polymerization proceeds by chain transfer reaction, and the cationic polymerization type curing agent enables production of a cured product of a high crosslinking density (high glass transition temperature) at a lower temperature in a shorter time.

The cationic polymerization initiator includes aromatic iodonium salts and aromatic sulfonium salts [see J. Polymer Sci. Symposium No. 56, 383–395 (1976)], Irgacure 261 (Trade Name, supplied by Ciba Geigy Co.), SP-170 and SP-150 (Trade Names, supplied by Asahi Denka Kogyo K.K.), and so forth. These cationic polymerization initiator initiates cationic polymerization by irradiation of ultraviolet ray. The cationic polymerization can be initiated by heating by use of combination of CP-66, CP-77 (Trade Names, supplied by Asahi Denka K.K.), or an aromatic iodonium salt with a copper compound [see J. Polymer Sci.: Polymer Chemical Edition, Vol. 21, 97–109 (1983)].

The cured epoxy resin may contain a suitable additive if necessary. For example, a flexibility-imparting agent may be incorporated for lowering the elastic modulus of the epoxy resin, or a silane-coupling agent may be incorporated for improving further the adhesiveness to the base plate.

The process for producing a liquid jet recording head employing the constituting member of the present invention is described below by reference to drawings.

FIG. 1 shows a base plate 1 having ink pressure-generating elements 2 and an ink-supplying opening 3 formed thereon. Control signal inputting electrodes (not shown in the drawing) are connected to the ink pressure-generating elements.

Figure 2:
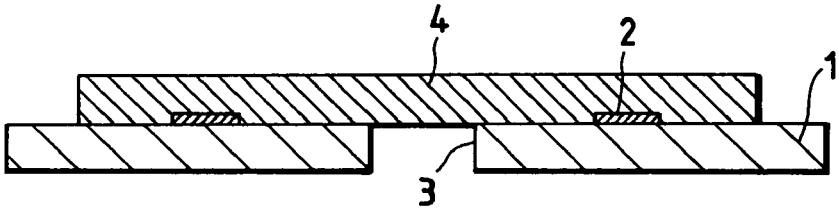
FIG. 2 is a schematic view showing the base plate having an ink flow path pattern formed thereon.

On the base plate 1, an ink flow path pattern 4 is formed from a soluble resin as shown in FIG. 2 showing a cross sectional view. The soluble resin layer may be suitably formed from a positive type resist.

Figure 3:
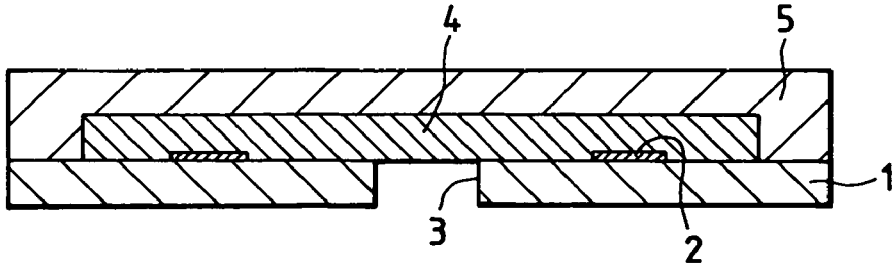
FIG. 3 is a schematic view showing the base plate having a coating resin layer formed thereon.

A coating resin layer 5 of the present invention is formed on the above flow path pattern 4 as shown in FIG. 3. The coating layer is suitably formed by a solvent-coating method (application of a coating resin solution in a suitable solvent), typically spin coating in view of uniformity of the layer thickness. In the spin coating, the coating resin should be dissolved uniformly in the coating solvent. An incompatible portion in a considerable amount may impair the uniformity of the thickness of the formed layer (especially in a dispersion system).

Figure 4:
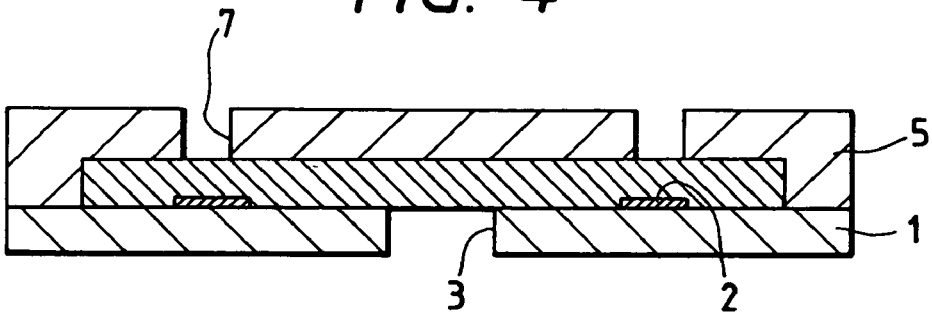
FIG. 4 is a schematic view showing ink discharge openings made in the coating resin layer formed on the base plate.

Then the coating resin layer is cured by application of optical or thermal energy. When a photopolymerization initiator is employed as the curing agent for the coating resin layer, ink discharge openings 7 are formed by patterning light exposure, or when the coating resin layer is thermally cured, the ink discharge openings 7 are formed by excimer laser processing or oxygen plasma etching through a suitable mask as shown in FIG. 4.

Figure 5:
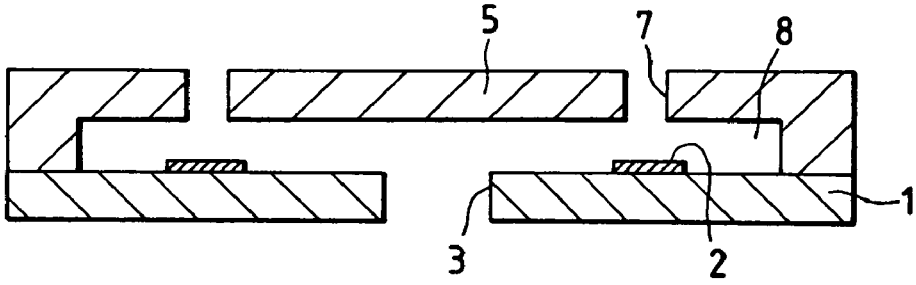
FIG. 5 is a schematic view showing a completed liquid jet recording head by removing the ink flow path pattern.

Finally, the ink flow path pattern 4 is removed by dissolution to complete a liquid jet recording head as shown in FIG. 5.

According to the above production process, a liquid jet recording head can be formed with sufficiently high precision of the distance between the discharge energy-generating element and the ink discharge opening and precision of the positions of the discharge openings, which are the most important factors for ink discharge performance. In the above liquid jet recording head, the thin coating resin layer 5, which constitutes the nozzle portion on the ink-supplying opening, is required to cause minimum deformation by swelling by water absorption and to have high mechanical strength.

The water absorbency of the resin composition for constituting the liquid jet recording head of the present invention was measured as below.

The resin compositions of Experiments 1–11 were formed respectively into a resin layer by dissolving the resin composition in a methyl isobutyl ketone/xylene, applying the solution onto a glass plate by spin coating, and drying it. The resin layer formed on the glass base plate was exposed to light for 30 seconds by means of a mask aligner PLA 520 (manufactured by Canon K.K.) with a cold mirror CM 250, and baked at 100° C. for one hour to cause cationic polymerization. The thickness of the resin layer was adjusted to be 10 μm on the glass base plate.

The obtained resin layer with the glass base plate was immersed into an ink composed of pure water, diethylene glycol, isopropyl alcohol, water soluble black dye, and lithium acetate (constituting ratio: 79.4/15/3/2.5/0.1). The water absorbency was determined by a pressure cooker test (PCT: 120° C., 2 atm, 50 hours). The weight increase of the glass plate carrying the resin layer by the immersion in the ink was measured.

The results are shown in Table 1. Experiments 1–4, 7, 8, and 10 relate to the resin compositions of the present invention, and Experiments 5, 6, 9, and 11 relate to conventional resin compositions. From the results, the coexistence of the fluorocarbon moiety-containing compound linked to the epoxy resin decreased the water absorbency of the epoxy resin remarkably to a level of ⅓ to 1/10 of the simple epoxy resin.

The resin compositions of the present invention were used for production of liquid jet recording heads, and were evaluated. The evaluation is explained by reference to the drawings.

EXAMPLE 1

Onto a silicon wafer 1 having a thermal oxidized $SiO_2$ film, electrothermal transducer elements (heaters composed of $HfB_2$) 2 and an ink-supplying opening 3 were formed as shown in FIG. 1. Separately, a dry film was prepared, as a soluble resin layer, by applying polymethyl isopropyl ketone (ODUR-1010, produced by Tokyo Ohka Kogyo Co., Ltd.) onto a PET sheet and drying it. The ODUR was concentrated before use. This dry film was transferred and laminated onto the above silicon wafer. The laminated matter was baked at 120° C. for 20 minutes, and then was exposed for 1.5 minutes in a pattern of an ink flow path by means of a mask aligner PLA 520 with cold mirror CM 290 (manufactured by Canon K.K.). The pattern was developed with a mixture of methyl isobutyl ketone and xylene (mixing ratio of 2:1 by weight), and rinsed with xylene. The resist pattern 4 is formed and kept remained for securing the ink flow path between the ink-supplying opening 3 and the electrothermal transducers 2 as shown in FIG. 2. The ink-supplying opening 3 had been formed in a breadth of 300 μm. The resist after the development had a layer thickness of 12 μm.

Then, as shown in FIG. 3, a coating layer 5 was formed by applying a solution of the resin composition of this example shown in Table 2 in methyl isobutyl ketone/xylene onto the above resist pattern 4 by spin coating, and drying it. The coating layer 5 formed on the silicon wafer was exposed for 30 seconds by means of a mask aligner PLA 520 with a cold mirror CM 250 (manufactured by Canon K.K.), and was baked at 100° C. for one hour to cause cationic polymerization. The thickness of the coating resin layer 5 was controlled to be 10 μm on the ink flow path pattern.

Figure 6:
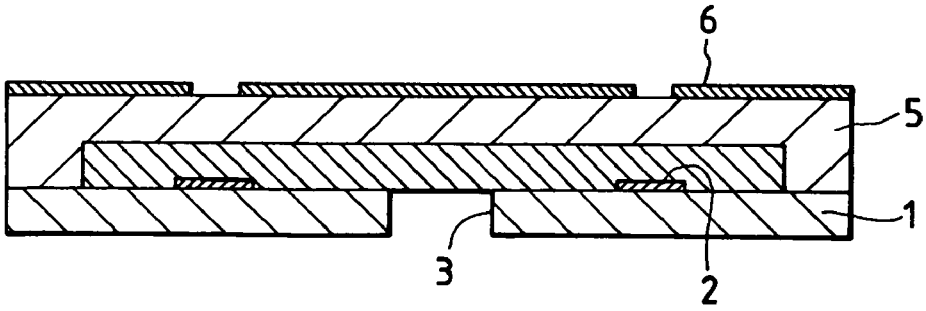
FIG. 6 is a schematic view showing a resist pattern formed on the coating resin layer for discharge openings.

Onto the cured resin coating film 5, a silicone type negative resist (SNR: produced by Toso Co.) 6 was formed in a thickness of 0.3 μm by spin coating, and was baked at 80° C. of 20 minutes. This silicone type resist layer was exposed to light irradiation through a mask of a pattern corresponding to the ink-supplying opening by contact exposure at a exposure light quantity of the layer of about 60 $mj/cm^2$ by means of a mask aligner PLA 520 (with CM 250). The pattern was developed by toluene for one minute, and was rinsed by immersing into isopropyl alcohol for 30 seconds. This silicone type resist was a negative type resist, and the pattern of the ink-supplying opening was formed by cutting. The negative resist is generally not suitable for fine pattern formation. However, because of the thinness of the resist film in this example, a pattern can be formed in size of about 2 μm in diameter. In this example, discharge opening pattern of 15 μm in diameter was formed (see FIG. 6).

Figure 7:
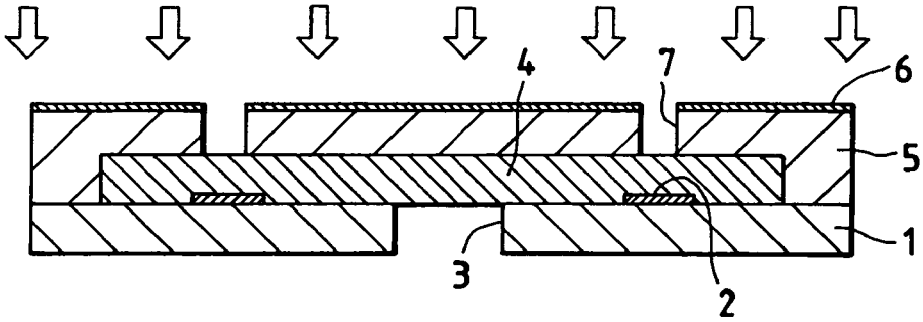
FIG. 7 is a schematic view showing the coating resin layer etched to form discharge openings.

The epoxy resin layer was etched by oxygen plasma in a parallel plate type dry etching apparatus (DEM-451: Anerpa Co.) at an oxygen gas pressure of 15 Pa and an input power of 150 W. The etching time was selected suitably for respective resin compositions. The through holes for ink-supplying openings 7 are formed by the etching (see FIG. 7). The degree of anisotropy of the etching can be changed by changing the oxygen gas pressure or the input power to control the shape in the depth direction of the discharge opening to some extent. Reportedly, use of a magnetron type etching apparatus enables shortening of the etching time to improve the throughput.

Figure 8:
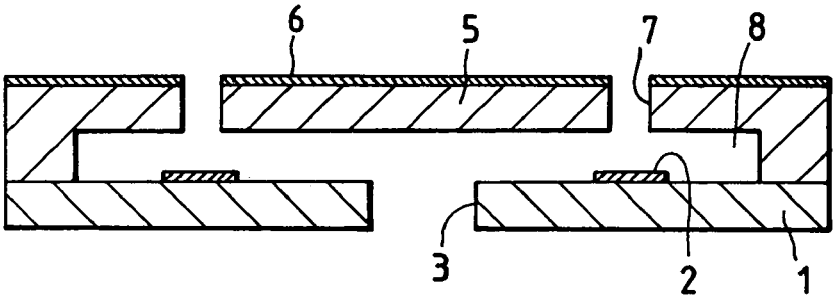
FIG. 8 is a schematic view showing that the coating resin layer has been removed by light exposure and dissolution.

The soluble resin layer (ODUR-1010) 4 was removed by light exposure for 2 minutes by means of PLA-520 (with CM290) and dissolution in methyl isobutyl ketone by application of ultrasonic wave by an ultrasonic washing apparatus for the ink flow path 8 (see FIG. 8). The resulting base plate was baked at 150° C. for one hour.

Figure 9:
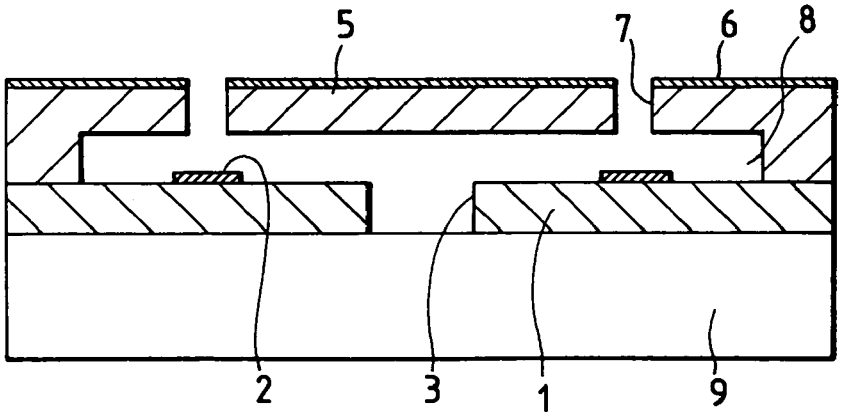
FIG. 9 is a schematic view showing that an ink-supplying member has been bonded to complete a liquid jet recording head.

Finally, an ink-supplying member 9 was bonded to the ink-supplying opening as shown in FIG. 9 to complete a liquid jet recording head.

EXAMPLE 2

An ink flow path pattern 4 was formed through the same steps in the same manner as in Example 1. Onto the ink flow path pattern 4, a coating resin layer was formed by applying a solution of the composition shown in Table 2 in a mixed solvent of methyl isobutyl ketone and xylene by spin coating. The cationic polymerization initiator SP170 serves to initiate cationic polymerization by light irradiation, and copper triflate was used as an accelerator for the cationic polymerization.

Since the composition shown in Table 2 has negative photosensitivity, light exposure was conducted with a mask shielding the discharge opening portions by means of a mask aligner MPA 600 (manufactured by Canon K.K.) at exposure light quantity of 3.5 J/cm$^2$. After the light exposure, the composition was baked at 90° C. for 10 minutes, developed by a mixed solvent of methyl isobutyl ketone and xylene, and rinsed with xylene. The discharge openings were 20 μm in diameter, and the coating resin layer was 10 μm thick on the ink flow path pattern.

Thereafter, the ink flow path pattern 4 was removed by elution in the same manner as in Example 1. The coating resin layer was completely cured by baking at 180° C. for one hour. Finally an ink-supplying member was bonded thereto to complete a liquid jet recording head.

EXAMPLE 3

A liquid jet recording head was prepared in the same manner as in Example 2 except that the coating resin layer was formed from the composition shown in Table 2.

COMPARATIVE EXAMPLES 1 AND 2

Liquid jet recording head were prepared in the same manner as in Example 2 except that the coating resin layer was formed respectively from the composition shown in Table 2.

The obtained liquid jet recording heads were stored with ink filled therein in a closed vessel at 60° C. for 3 months to evaluate the reliability of the heads for a long term.

After the storage, the ink-contacting surface was observed by microscope. No significant change was observed in the heads of Examples 1–3, whereas in the heads of Comparative Examples 1 and 2, surface roughness was observed in the portions of the coating resin layer 5 above the ink-supplying opening.

The heads after the storage were used for printing a solid black test pattern on a recording paper sheet of A4 size. The heads of Examples 1–3 could print the test pattern stably. However, the heads of Comparative Examples 1 and 2 caused white streaks locally in continuous printing test, which is considered to be due to deviation of ink discharge direction. By careful observation, the white streaks are found in a large number in the portions corresponding to concave distortion of the coating resin layer. This is probably caused by stagnation of the ink in the concave of the coating resin layer to give rise to deviation of the ink discharge direction.

The heads of Comparative Examples 1 and 2, after drainage of the ink, were washed with water, and dried at 80° C. under a reduced pressure. Neither concave nor protrusion of the coating resin layer was observed in the heads. From this, the concave or the protrusion is understood to be ascribable to water absorption of the coating resin layer.

As shown in Examples, the head employing the coating resin layer of the present invention is highly reliable without swell caused by water absorption of the coating resin layer during use for a long term.

TABLE 1

| Experiment No. | Epoxy compound [parts] | Fluorocarbon-containing compound [parts] | Cationic polymerization initiator [parts] | Additive [parts] | Water absorption |
|---|---|---|---|---|---|
| 1 | EHPE-3150 Oxycyclohexane epoxy (Daicel Chem. Ind. Co.) [74] | $HO—CH_2-(CF_2)_3-CH_2—OH$ (Idemitsu Petrochem. Co.) [20] | 4,4'-di-t-butyldiphenyliodonium hexafluoroantimonate [1] | A-187 Epoxy type silane coupling agent (Nippon Unicar Co.) [5] | +0.1% |
| 2 | EHPE-3150 Oxycyclohexane epoxy (Daicel Chem. Ind. Co.) [79] | 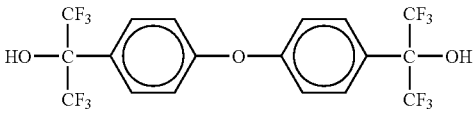 (Fluorochem. Co.) [15] | 4,4'-di-t-butyldiphenyliodonium hexafluoroantimonate [1] | A-187 Epoxy type silane coupling agent (Nippon Unicar Co.) [5] | +0.2% |
| 3 | EHPE-3150 Oxycyclohexane epoxy (Daicel Chem. Ind. Co.) [84] | $CF_3-(CF_2)_5-CH_2—OH$ [10] | 4,4'-di-t-butyldiphenyliodonium hexafluoroantimonate [1] | A-187 Epoxy type silane coupling agent (Nippon Unicar Co.) [5] | +0.2% |

TABLE 1-continued

| Experiment No. | Epoxy compound [parts] | Fluorocarbon-containing compound [parts] | Cationic polymerization initiator [parts] | Additive [parts] | Water absorption |
|---|---|---|---|---|---|
| 4 | EHPE-3150 Oxycyclohexane epoxy (Daicel Chem. Ind. Co.) [77] | 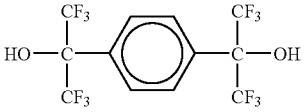 [17] | 4,4'-di-t-butyldiphenyliodonium hexafluoroantimonate [1] | A-187 Epoxy type silane coupling agent (Nippon Unicar Co.) [5] | +0.3% |
| 5 | EHPE-3150 Oxycyclohexane epoxy (Daicel Chem. Ind. Co.) [74] | none *[—] | 4,4'-di-t-butyldiphenyliodonium hexafluoroantimonate [1] | A-187 Epoxy type silane coupling agent (Nippon Unicar Co.) [5] | +0.9% |
| 6 | EHPE-3150 Oxycyclohexane epoxy (Daicel Chem. Ind. Co.) [74] | $HO—CH_2-(CF_2)_3-CH_2—OH$ [20] | 4,4'-di-t-butyldiphenyliodonium hexafluoroantimonate [1] | A-187 Epoxy type silane coupling agent (Nippon Unicar Co.) [5] | +0.8% |
| 7 | Epicoat 1002 Bisphenol A-type epoxy (Yuka Shell epoxy Co.) [74] Epolite 3002 Propylene glycol-modified bisphenol A type epoxy [Kyoei K.K.] [10] | $HO—CH_2-(CF_2)_3-CH_2—OH$ (Fluorochem. Co.) [14] | 4,4'-di-t-butyldiphenyliodonium hexafluoroantimonate [1] | A-187 Epoxy type silane coupling agent (Nippon Unicar Co.) [5] | +0.1% |
| 8 | Epicoat 180 H65 Orthocresol-novolak type epoxy (Yuka Shell Epoxy Co.) [74] Epolite 3002 [10] | $HO—CH_2-(CF_2)_3-CH_2—OH$ (Fluorochem. Co.) [14] | 4,4'-di-t-butyldiphenyliodonium hexafluoroantimonate [1] | A-187 Epoxy type silane coupling agent (Nippon Unicar Co.) [5] | +0.1% |
| 9 | Epicoat 1002 [74] Epolite 3002 [10] | none [—] | 4,4'-di-t-butyldiphenyliodonium hexafluoroantimonate [1] | A-187 Epoxy type silane coupling agent (Nippon Unicar Co.) [5] | +0.7% |
| 10 | Epicoat 180 H65 [69] CY 175 Alicyclic epoxy resin [15] | $HO—CH_2-(CF_2)_3-CH_2—OH$ (Fluorochem. Co.) [14] | 4,4'-di-t-butyldiphenyliodonium hexafluoroantimonate [1] | A-187 Epoxy type silane coupling agent (Nippon Unicar Co.) [5] | +0.5% |
| 11 | Epicoat 180 H65 [69] CY 175 Alicyclic epoxy resin [15] | none [—] | 4,4'-di-t-butyldiphenyliodonium hexafluoroantimonate [1] | A-187 Epoxy type silane coupling agent (Nippon Unicar Co.) [5] | +1.5% |

*Not fluorocarbon

TABLE 2

| Example No. | Epoxy compound [parts] | Fluorocarbon-containing compound [parts] | Cationic polymerization initiator [parts] | Additive |
|---|---|---|---|---|
| 1 | EHPE-3150 Oxycyclohexane epoxy (Daicel Chem. Ind. Co.) [74] | $HO—CH_2-(CF_2)_3-CH_2—OH$ (Idemitsu Petrochem. Co.) [20] | 4,4'-di-t-butyldiphenyliodonium hexafluoroantimonate [1] | A-187 Epoxy type silane coupling agent (Nippon Unicar Co.) [5] |

TABLE 2-continued

| | Epoxy compound [parts] | Fluorocarbon-containing compound [parts] | Cationic polymerization initiator [parts] | Additive |
|---|---|---|---|---|
| 2 | EHPE-3150 Oxycyclohexane epoxy (Daicel Chem. Ind. Co.) [100] | 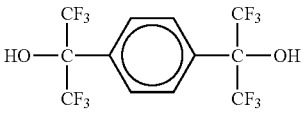 (Fluorochem. Co.) [20] | SP 170 [2] Copper triflate [0.01] | A-187 Epoxy type silane coupling agent (Nippon Unicar Co.) [5] |
| 3 | Epicoat 180 H65 [80] | 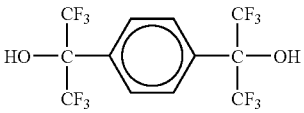 (Fluorochem. Co.) [20] | SP 170 [2] Copper triflate [0.01] | A-187 Epoxy type silane coupling agent (Nippon Unicar Co.) [5] |
| Comparative Example | | | | |
| 1 | EHPE-3150 [100] | none [—] | SP 170 [2] Copper triflate [0.01] | A-187 Epoxy type silane coupling agent (Nippon Unicar Co.) [5] |
| 2 | Epicoat 180 H65 [80] | none [—] | SP 170 [2] Copper triflate [0.01] | A-187 Epoxy type silane coupling agent (Nippon Unicar Co.) [5] |

What is claimed is:

1. A liquid jet recording head comprising:

a liquid flow path having a coating resin layer formed from a cured product of a resin composition comprising (1) a curable epoxy compound, (2) a compound having a functional group reactive to the curable epoxy compound and a fluorocarbon moiety, and (3) a curing agent, wherein the curable epoxy compound and the compound having a functional group reactive to the curable epoxy compound and a fluorocarbon moiety are polymerized, wherein the coating resin layer facilitates a smooth flow of ink through the liquid flow path, and wherein the contact angle of the cured product of the resin composition is approximately the same as the contact angle of a cured product of the curable epoxy compound.

2. The liquid jet recording head according to claim 1, wherein the curing agent is a cationic polymerization initiator, and the resin composition is cured by cationic polymerization.

3. The liquid jet recording head according to claim 1, wherein the compound having a functional group reactive to the curable epoxy compound and a fluorocarbon moiety contains fluorine at content ranging from 20% to 80% by weight.

4. The liquid jet recording head according to claim 1, wherein the functional group reactive to the curable epoxy compound is a hydroxyl group.

5. The liquid jet recording head according to claim 4, wherein the compound having a functional group reactive to the curable epoxy compound and a fluorocarbon moiety is represented by General Formula (1):

$$HO—CH_2—(CF_2)_n—CH_2—OH \quad (1)$$

where n is an integer of from 1 to 20.

6. The liquid jet recording head according to claim 4, wherein the compound having a functional group reactive to the curable epoxy compound and a fluorocarbon moiety is represented by General Formula (2):

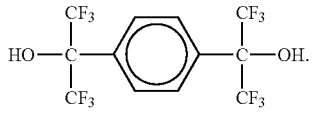

(2)

7. The liquid jet recording head according to claim 1, wherein the curable epoxy compound is selected from aromatic epoxy compounds.

8. The liquid jet recording head according to claim 1, wherein the curable epoxy compound is selected from alicyclic epoxy compounds.

9. The liquid jet recording head according to claim 1, wherein the curable epoxy compound is selected from epoxy compounds having an oxycyclohexane skeleton in the molecular structure thereof.

10. A process for producing a liquid jet recording head, comprising the steps of:

(I) forming a liquid flow path pattern from a soluble resin on an ink discharge pressure-generating element on a base plate;

(II) forming a coating resin layer on the soluble resin layer; and (III) removing the soluble resin layer by elution to form a liquid flow path, wherein the coating resin layer is formed from a cured product of a resin composition comprising (1) a curable epoxy compound, (2) a compound having a functional group reactive to the curable epoxy compound and a fluorocarbon moiety, and (3) a curing agent, wherein the curable epoxy compound and the compound having a functional group reactive to the curable epoxy compound and a fluorocarbon moiety are polymerized, wherein the coating resin layer facilitates a smooth flow of ink through the liquid flow path, and wherein the contact angle of the cured product of the resin composition is approximately the same as the contact angle of a cured product of the curable epoxy compound.

11. The process for producing a liquid jet recording head according to claim 10, wherein the process further comprises a step of forming a discharge opening through the coating resin layer.

12. The process for producing a liquid jet recording head according to claim 11, wherein the coating resin layer is formed from a photosensitive resin, and the discharge opening is formed by photolithography.

13. The process for producing a liquid jet recording head according to claim 11, wherein the discharge opening is formed by oxygen plasma etching.

14. The process for producing a liquid jet recording head according to claim 11, wherein the discharge opening is formed by excimer laser irradiation.

* * * * *

UNITED STATES PATENT AND TRADEMARK OFFICE

CERTIFICATE OF CORRECTION

PATENT NO. : 7,055,938 B1 
APPLICATION NO. : 08/634255
DATED : June 6, 2006
INVENTOR(S) : Norio Ohkuma et al.

It is certified that error appears in the above-identified patent and that said Letters Patent is hereby corrected as shown below:

ON THE TITLE PAGE (*) Notice:, Insert: --This patent issued on a continued prosecution application filed under 37 CFR 1.53(d), and is subject to the twenty year patent term provisions of 35 U.S.C. 154(a)(2).--.

(56) References Cited, Foreign Patent Documents, "5138882" should read --5-138882--.

COLUMN 4

Line 20, "649216," should read --64-9216,--.

COLUMN 6

Line 36, "These" should read --This--.

COLUMN 8

Line 32, "of 20" should read --for 20--;
Line 62, 'PLA-520" should read --PLA 520--; and
Line 63, "CM290)" should read --CM 290)--.

COLUMN 9

Table 1, Experiment No.3, "$CF_3$-$(CF_2)_5$-$CH_2$—OH" should read --$CF_3$-$(CF_2)_6$-$CH_2$—OH--.
[10] [10]

COLUMN 12

Table 2, Heading, "Additive" should read --Additive--.
[parts]

UNITED STATES PATENT AND TRADEMARK OFFICE

CERTIFICATE OF CORRECTION

PATENT NO. : 7,055,938 B1
APPLICATION NO. : 08/634255
DATED : June 6, 2006
INVENTOR(S) : Norio Ohkuma et al.

It is certified that error appears in the above-identified patent and that said Letters Patent is hereby corrected as shown below:

COLUMN 14

Table 2, Heading, "Additive" should read --Additive--.
[parts]

Signed and Sealed this

Nineteenth Day of December, 2006

JON W. DUDAS
*Director of the United States Patent and Trademark Office*